United States Patent [19]

Conte

[11] 4,225,910

[45] Sep. 30, 1980

[54] EXTENSION LAMP APPARATUS

[76] Inventor: Daniel Conte, Avenue Marcel Pagnol, Aix en Provence, France, 13100

[21] Appl. No.: 3,870

[22] Filed: Jan. 16, 1979

[30] Foreign Application Priority Data

Jan. 19, 1978 [FR] France ..... 78 02444

[51] Int. Cl.[3] ..... F21V 17/06; F21V 15/02

[52] U.S. Cl. ..... 362/376; 362/378; 362/382

[58] Field of Search ..... 362/376–378, 362/382, 365

[56] References Cited

U.S. PATENT DOCUMENTS

| | | | |
|---|---|---|---|
| 1,450,253 | 4/1920 | Douglas | 362/365 |
| 1,700,167 | 1/1929 | Kollath | 362/378 |
| 1,761,436 | 6/1930 | Douglas | 362/382 |
| 1,958,222 | 5/1934 | Wilson | 362/378 |
| 1,995,172 | 3/1935 | Douglas | 362/382 |
| 2,085,683 | 6/1937 | McGill | 362/396 |
| 2,096,604 | 10/1937 | Bissell | 362/376 |
| 2,172,223 | 9/1939 | Riddle | 362/378 |
| 2,248,399 | 7/1941 | Watts | 362/382 |
| 2,315,026 | 3/1943 | Sullam | 362/376 |
| 2,385,655 | 9/1945 | Schmieder | 362/378 |
| 2,394,697 | 2/1946 | Kollath | 362/376 |
| 2,470,280 | 5/1949 | Ackerman | 362/382 |
| 2,549,487 | 4/1951 | Kollath | 362/378 |
| 2,773,973 | 12/1956 | Hoard et al. | 362/376 |
| 3,767,913 | 10/1973 | Trevithick | 362/378 |
| 3,917,941 | 11/1975 | Trevithick | 362/376 |

FOREIGN PATENT DOCUMENTS

| | | | |
|---|---|---|---|
| 715432 | 10/1966 | Italy | 362/376 |
| 426312 | 4/1935 | United Kingdom | 362/376 |

*Primary Examiner*—Teddy S. Gron

*Attorney, Agent, or Firm*—Sandler & Greenblum

[57] ABSTRACT

An extension lamp apparatus comprising: a protective grill having an essentially undeformable base; a handle comprising a resiliently deformable upper section; and a bulb socket; whereby the base of the grill is fitted over the upper portion of the handle and the socket is force fitted within the upper section of the handle thereby locking the base of the protective grill in place.

8 Claims, 2 Drawing Figures

EXTENSION LAMP APPARATUS

BACKGROUND OF THE INVENTION

The present invention relates to extension lamps of the non-disassemblable type, i.e., in which it is not possible to change or replace anything but the bulb (to the exclusion of the other components, e.g., handle, socket, basket, feed line).

Extension lamps or "trouble lights" as they are commonly known are generally disassemblable devices so that one can replace one or several elements which prematurely wear out and detract from the operation of the assembly.

Disassemblable extension lamps suffer from two types of inconveniences, particularly for models adapted for use by the public, which are of lighter construction than those adapted for use in industry: the connector elements are causes of fragility; and the feed cable, which must necessarily be of the double insulation type (e.g., HO5RRF or 4HO5 VVF) so as to avoid accidents resulting from repacement of the cable by a light wire by people misinformed as to the dangers which result when such devices are used under poor conditions.

SUMMARY OF THE INVENTION

It is, therefore, an object of the invention to provide a non-disassemblable extension lamp, whose cost is low, and which has the advantage of being structurally solid and safe, yet is constructed such that an attempt at disassembly renders the components completely useless while resulting in improved component reliability.

While such an objective can be attained by different processes, such as by crimping the protector grill basket on the handle or by glueing or welding the socket on the handle, the device according to the invention, has the advantage of the simultaneous assembly on the handle, the socket and the protector grill or basket by taking advantage of the elasticity of the two former and the rigidity of the grill.

DESCRIPTION OF PREFERRED EMBODIMENTS

Figure 1:
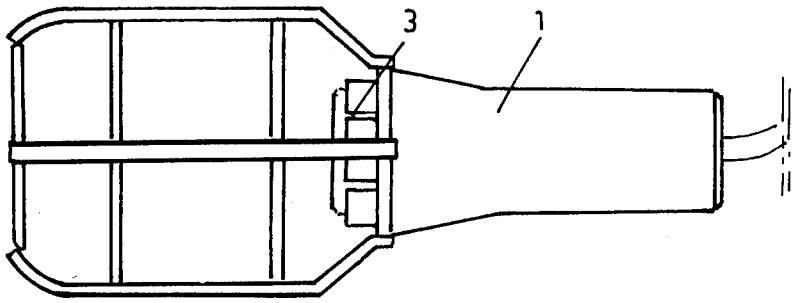
FIG. 1 illustrates an entire view of one such extension lamp.

The present invention results in the final disassemblable construction of the essential elements of the extension lamp assembly (handle, grill, socket, feed cable) so as to increase, on the one hand, reliability by reducing the number of components, and on the other hand, safety by redering the components practically useless in case of an attempt at disassembly, so as to avoid, in particular, replacement of the feed cable by an insufficiently protected wire.

The device comprises a handle 1 whose upper end is rendered sufficiently elastic to receive the rigid end of a protector grill 2. These two parts are subsequently blocked by the forced fitting of a socket 3 which is too inaccessible to be thus disassembled.

This socket, when of the bayonet type, comprises piston contacts 9 of one piece construction and springs 10 situated to the exterior of the contact which cannot lose their elasticity by virtue of heating caused by the passage of electric current.

The invention can be utilized with extension lamps with or without glass casing, whether or not they are equipped with clips and/or a reflector. The assembly of the grill on the handle by means of the socket, can be utilized in conjunction with an edison E27 or E14 socket as well as with a bayonet socket B15.

The handle 1 is fabricated out of a relatively rigid material, such as polypropylene, nylon, etc. The end is made elastic or flexible by providing gaps or slits along a portion of the surface of the handle.

Figure 2:
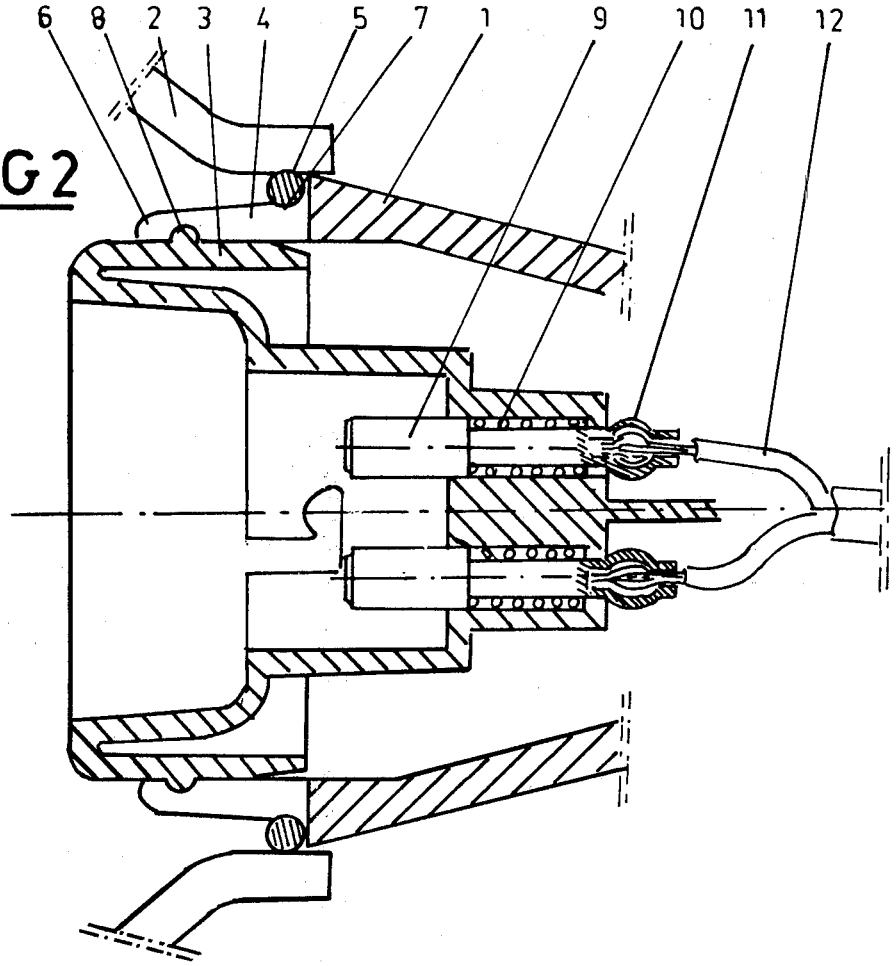
FIG. 2 illustrates a magnified, detailed view of one embodiment of the device.

The grill 2, generally made of steel wire, ends in a rigid ring or torus 5. This torus is force fitted over the handle whose external portion comprises a conical or rounded section 6, to facilitate the introduction of the ring and a groove 7. Handle 1 extends generally outwardly until it reaches the point at which groove 7 is formed in the upper end or section of the handle. The upper portion of the handle then extends inwardly from the groove in a direction generally opposite to the direction of the outwardly extending portion of the handle, as illustrated in FIG. 2. The grill includes a plurality of downwardly extending grill sections which are attached to and which extend beyond the rigid ring 5 and groove 7, as is also illustrated in FIG. 2. A retaining ring, or a like clipping means, is used to assure the positioning of the torus around the handle. The torus is thus locked or crimped around the handle, which prevents its removal.

The socket 3 has at its outer portion a profile or rib 8. This rib is used for purposes of retention when the socket is force fitted into the handle which comprises, at its internal portion, a corresponding groove or cut out.

As a result of the forced introduction of the socket, whose external diameter is slightly greater than the internal diameter of the handle, the arcs between the gaps forming the top of the handle spread and block the torus 5, thus impeding extraction of the grill.

The assembly is thus non-disassemblable because the portion of the socket 3 remaining visible presents no outline making it possible to extract even with a tool.

The socket can be either an edison screw type E27, or E.14, or a B22 or B15 bayonet.

In the case of a bayonet socket, the socket can be of a special design as much in the principle of operation of the piston contacts as in the attachment of the conductors.

With conventional piston contacts the current passes from a fixed portion, integral with the body of the socket, to a movable portion, by a sliding contact formed by means of a delicate crimping or fitting process. An internal spring assures both the displacement of the movable portion and sufficient contact pressure with the base of the bulb.

The frequent replacement of the bulbs of an extension lamp tends to loosen the crimping such that the current circulates poorly and a portion of the current is deviated by the spring which heats itself, thus losing its elasticity, and itself causing a heating at the contact with the base of the bulb.

The device of the present invention comprises a piston contact 9 comprising a single conductive piece arranged between the conductor and the base of the bulb. Pressure is assured by means of an exterior spring 10, which cannot become a part of the electric circuit and thus conserves its elasticity.

In this embodiment the attachment of the conductor 12 can be made directly by crimp 11 which can also serve to retain the piston in its course of movement. This device, in addition to its great reliability, additionally has the advantage, in the present case, of making it practically impossible to change the cable 12, which is desirable to increase the security of the present apparatus.

The advantages of the invention result from the description given above by way of example only, and should not be construed as limited to the figures shown on the attached drawings.

The elements forming the object of the invention may be used with all types of trouble lights, extension lamps or portable lighting devices, whether or not they are provided with a glass casing or whether the protective grill is equipped or fabricated out of a reflector and whether the assembly additionally comprises a hanger assembly such as a clip or hook.

What is claimed is:

1. A non-disassemblable extension lamp apparatus comprising:

(a) a protective grill having an essentially undeformable base and comprising a plurality of downwardly extending grill sections and a rigid ring, said grill sections connected to and extending beyond said ring;

(b) a handle comprising a resiliently deformable upper section, said handle extending generally outwardly from its lower section towards a continuous outer groove which is formed in said upper section, said upper section then extending inwardly from said outer groove in a direction generally opposite to the lower section and having an inner groove; and (c) a resilient bulb socket having a protruding rib; whereby said ring is fitted into said outer groove and over the upper section of said handle and said socket is force-fitted within the upper section of said handle thereby locking said rib in said inner groove and locking said ring of said protective grill in place and preventing removal of said grill from said handle.

2. The extension lamp apparatus as defined by claim 1 wherein said resiliently deformable upper section of said handle comprises gaps therein adapted to permit said upper section to be deformed.

3. The extension lamp apparatus as defined by claim 1 wherein said socket is a bayonet socket.

4. The extension lamp apparatus as defined by claim 3 wherein said bayonet socket comprises two piston contact elements, each of said piston contact elements being slidably engaged within a bore in the base of said socket.

5. The extension lamp apparatus as defined by claim 4 wherein the top of each of said piston contacts extends out of the top of said bore to contact the base of a bulb inserted in said socket and the bottom of each of said piston contacts is adapted to be attached to an electrical cable.

6. The extension lamp apparatus as defined by claim 5 further comprising an electrical cable having two leads and wherein said bottom of each of said piston contacts is crimped around one of said leads.

7. The extension lamp apparatus as defined by claim 6 wherein each of said piston contacts comprises larger and smaller diameter portions, said smaller diameter portion being arranged within said bore, and being surrounded by a spring adapted to exert an upwardly directed force on each of said piston contacts.

8. The extension lamp apparatus as defined by claim 1 wherein said grill sections also extend beyond said outer groove.

* * * * *